US009539480B1

(12) United States Patent
Boswell

(10) Patent No.: US 9,539,480 B1
(45) Date of Patent: Jan. 10, 2017

(54) GOLF TEE MEASURING APPARATUS AND DIVOT REPAIR TOOL

(71) Applicant: Thomas K. Boswell, Elk Ridge, UT (US)

(72) Inventor: Thomas K. Boswell, Elk Ridge, UT (US)

( * ) Notice: Subject to any disclaimer, the term of this patent is extended or adjusted under 35 U.S.C. 154(b) by 0 days.

(21) Appl. No.: 14/804,173

(22) Filed: Jul. 20, 2015

(51) Int. Cl.
*A63B 57/50* (2015.01)
*A63B 57/00* (2015.01)

(52) U.S. Cl.
CPC ..... *A63B 57/0037* (2013.01); *A63B 57/0032* (2015.10); *A63B 57/0068* (2013.01); *A63B 57/50* (2015.10)

(58) Field of Classification Search
CPC ..... A63B 57/50; A63B 57/0032; A63B 57/10; A63B 57/0037
See application file for complete search history.

(56) References Cited

U.S. PATENT DOCUMENTS 4,151,937 A * 5/1979 Jarosh ..... A45C 11/00 206/315.1
4,535,987 A * 8/1985 Dikoff ..... A63B 57/00 116/225
5,388,824 A * 2/1995 Reimers ..... A63B 57/00 473/406
5,645,500 A * 7/1997 Borden ..... A63B 57/00 473/286
6,413,173 B1 * 7/2002 Muller ..... A63B 57/50 473/408
6,413,174 B1 * 7/2002 Roberts ..... A63B 57/50 473/408
D468,385 S * 1/2003 Fleischmann ..... D21/793
D473,279 S * 4/2003 Fleischmann ..... D21/789
7,044,866 B1 * 5/2006 Blauvelt ..... A63B 57/10 224/918
7,841,096 B1 * 11/2010 Jenkins ..... A63B 57/0037 33/485
7,850,550 B2 * 12/2010 Nania ..... A63B 57/0037 473/386
D676,918 S * 2/2013 Jenkins ..... D21/789
2008/0188328 A1 * 8/2008 Joffe ..... A63B 57/10 473/386
2009/0098952 A1 * 4/2009 Leiber ..... A63B 57/50 473/408
2011/0081994 A1 * 4/2011 Rourke ..... A63B 57/50 473/408

* cited by examiner

*Primary Examiner* — Steven Wong
(74) *Attorney, Agent, or Firm* — Steven Rinehart

(57) ABSTRACT

A golf tee measuring device and divot repair tool is provided for measuring the length of a golf tee, repairing divots, and housing a marker, the device comprising a housing defining an open aperture, a positioning slot within which a button travels, and an interior recess. The device further comprises a lower component having two extrudable prongs for repairing divots, the lower component defining a guide track recessed into an interior surface.

11 Claims, 10 Drawing Sheets

GOLF TEE MEASURING APPARATUS AND DIVOT REPAIR TOOL

BACKGROUND OF THE INVENTION

Field of the Invention

This invention relates to the game of golf and in particular, to a device measuring the length of a golf tee and replacing divots.

Description of the Related Art

A golfer's grip, stance, pivot, and follow-through all affect a golfer's work to achieve a consistent and ideal golf swing. The vertical point at which the face of the driver strikes the ball is also important. At the ideal striking point, a clubface makes initial contact with the midpoint of a golf ball at the driver's "sweet spot," or a portion of the clubface designed to provide the straightest drive. Initial contact with the ball above or below its center or above or below the clubface's sweet spot can result in excess spin, and a less accurate drive.

Golf tees are used by golfers to elevate the golf ball above the ground and facilitate contact at the ideal striking point. Conventional tees are typically made of wood or plastic, have a stake portion with a pointed end for insertion into the turf, and have a cupped end for supporting a ball. The optimal depth for insertion to facilitate the ideal striking point at a club's "sweet spot" is known to be the depth that allows the bottom of the club head to rest on the turf while the top of the club head is even with the center of the ball. Typically, the ordinary golfer inserts the tee into the ground relying upon his/her eyesight and best judgment to insert the tee into the turf at approximately the optimal depth.

The prior art teaches tee shafts having, for example lines, notches or a stopping mechanism, such as a removable or non-removable horizontal member that makes contact with the ground when the shaft is inserted to the proper depth.

A second problem with conventional tees, and one not addressed by the prior art, is the actual method of insertion depth estimation. Thus, while markings on a shaft may allow a golfer to insert his tee at the same depth each time, this does not guarantee that the depth consistently used is the optimal one. The fact that different tees differ in their overall height, and are marked in differing fashions, adds further complication. There exist no devices for efficiently inserting a tee into the ground with a predetermined length of shaft above the ground surface.

Although golfers are careful about positing their tees in the ground, tees often vary in their length, size and strength. A drawback of golf tees in the prior art are that they are not designed to allow the golfer to place the golf tee in the ground at the same depth every time, and the golfer cannot maintain the same body position every time. The golfer has to adjust his or her hands up or down the golf shaft to compensate for the varying height of the golf tee. Golfers' inability to judge the length of a tee and consistently place the tee at the same height distracts from a golfer's ability to concentrate on those factors mentioned above that require focus and practice. Problems with depth placement lead to loss of range and accuracy.

Additionally, when the ball lands on the green, it leaves a divot mark on the green. The golfer is expected to fix the divot on the green and divot tool is typically used for this green repair. Typically, these divots repaired as a matter of etiquette by the golfers. Divot repair tools combined with other golf devices do not exist in efficient form in the prior art. Golfers additionally lack a device for holding a marker for marking the position of balls on a course or ground surface.

There exists a need in the art for a device that accurately measures the height of golf tees above ground, that allows a golfer to replace divots, and holds a marker like a coin. Current methods and apparati are not effective.

SUMMARY OF THE INVENTION

From the foregoing discussion, it should be apparent that a need exists for a golf tee measuring device. Beneficially, such an apparatus would overcome many of the difficulties and safety concerns expressed, by providing a pocket-sized golf tee measuring device that can be quickly and easily used.

The present invention has been developed in response to the problems and needs in the art that have not yet been fully solved by currently available apparati and methods. Accordingly, the present invention has been developed to provide a golf tee measuring device and divot repair tool, the comprising: a housing defining an open interior recess, the housing having a top surface, a distal end and a proximal end, the housing defining an open aperture on the proximal end for receiving a golf tee, the housing defining an open positioning slot running longitudinally part way across the top surface; a lower component slidably affixed to the housing such that the lower component travels longitudinally across a predetermined distance with respect to the housing, the lower component comprising: an interior surface having a guide track recessed into the interior surface, the guide track running in a longitudinal direction, the interior surface comprising a first set of retention members protruding upwardly within the open recess from the bottom surface; and, a pair of extrudable prongs for engaging a divot; a plurality of measurement markings imprinted on the top surface of the housing in parallel with the positioning slot for measuring a length of a golf tee inserted into the housing; a button extending which travels within the positioning slot and abuts the end of a golf tee inserted in the positioning slot.

The apparatus may further comprise a spring housed within the open recess between the button and a distal end of the housing, the spring biasing the button toward the proximal end of the measuring device.

The apparatus may further comprise an oblong pad integrated with the lower component and protruding downwardly therefrom, the oblong pad comprising a plurality of ribs for engaging a golfer's finger. The button may travels back and forth within the guide track in a longitudinal direction over a predetermined distance. The button may further comprises ribs for engaging a finger of the user.

The button may further comprise markings for aligning the button with the linear markings on the housing. In some embodiments, the button further comprises markings for aligning the button with the linear markings on the housing.

The lower component may slide longitudinally with respect to the housing to extrude the prongs from the housing, the prongs for stabbing and repairing a divot. The hollow interior recess may house a marker for marking the position of a golf ball on a ground surface.

A second golf tee measuring device and divot replacer is disclosed, the device comprising: a housing defining an open interior recess, the housing having a top surface, a distal end and a proximal end, the housing defining an open aperture on the proximal end for receiving a golf tee and a marker, the housing defining an open positioning slot running longitudinally part way across the top surface; a lower component slidably affixed to the housing such that the lower component travels longitudinally with respect to the housing, the lower component comprising: an interior surface having a guide track recessed into the interior surface, the guide track running in a longitudinal direction; and, a pair of retractable prongs for repairing a divot, the prongs enveloped within the housing when the lower component is slid rearward, the prongs extruded when the lower component is slid forward; a button extending which travels within the positioning slot and abuts the end of a golf tee inserted in the positioning slot.

The marker may be insertable and removable when the apparatus is in an extruded configuration.

These features and advantages of the present invention will become more fully apparent from the following description and appended claims, or may be learned by the practice of the invention as set forth hereinafter

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
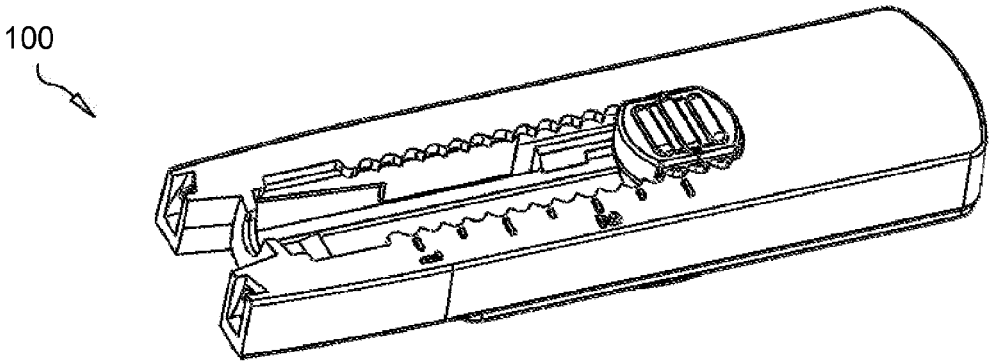
FIG. 1A is an elevational frontal-side perspective view of a device for measuring the length of a golf tee 100 with its divot repair tool retracted in accordance with the present invention.
Figure 1B:
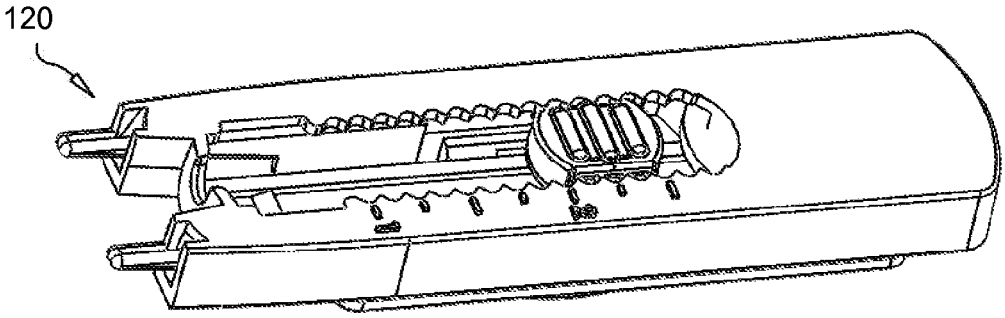
FIG. 1B is an elevational frontal-side perspective view of a device for measuring the length of a golf tee 120 with its divot repair tool partially extruded in accordance with the present invention.
Figure 1C:
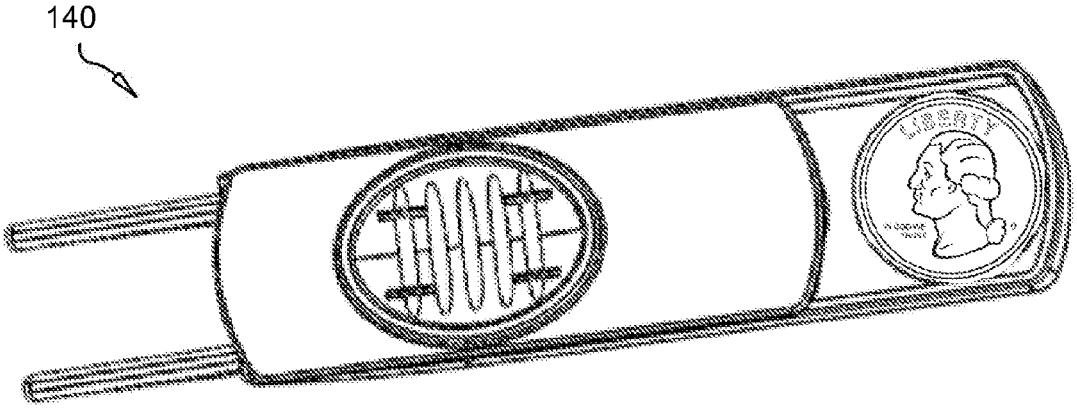
FIG. 1C is an lower perspective view of a device for measuring the length of a golf tee 140 with its divot repair tool extruded in accordance with the present invention.

Each of FIGS. 1A-1C show a golf tee measurer 100-140 in a different configuration. In FIG. 1A, the golf tee measurer 100 has its divot repair tool in a retracted position. The aspects of the device 100 are further described below. In FIG. 1B, the golf tee measurer 120 has its divot repair tool in a partially extruded position. In FIG. 1C, the golf tee measurer 140 has its divot repair tool in a fully extruded position. The device 140 houses a ball marker for marking the position of a golf ball on a putting or ground surface (which may be a quarter). The aspects of the device 140 are further described below.

Figure 1D:
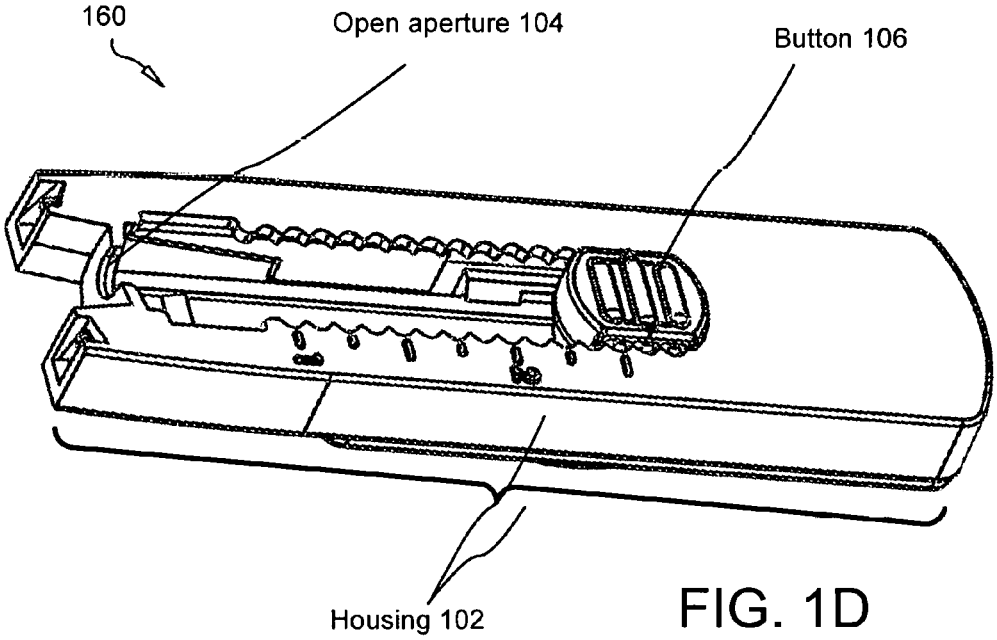
FIG. 1D is an elevational frontal-side perspective view of a device for measuring the length of a golf tee in accordance with the present invention.

FIG. 1D is an elevational frontal-side perspective view of a device 160 for measuring the length of a golf tee in accordance with the present invention. The measuring device 100 comprises a housing 102 defining an open aperture 104, and a button assembly (i.e. button) 106.

The housing 102 comprises a metal alloy or polymeric shell which defines an open interior recess. The front (or proximal end) of the housing 102 defines an open aperture 104 between two protruding extensions through which the shaft of a golf tee passes through. The golf tee, when inserted into the device 160, protrudes through open aperture 104, with its cup abutting and engaging the slidable button 106 as further shown below. A golfer (or user or operator) of the measuring device is able to thus measure the length of the portion of the golf tee inserted into the device 160, which is the same length of the golf tee rising above a ground surface when the protruding portion of the golf tee is pushed into a ground surface. A golfer may read graduated or linear markings engraved, imprinted, labeled, or printed on the top surface of the housing 102, which correspond to the length of the golf tee above ground.

The length of the golf tee received by the housing 102 is adjustable by sliding the button 106 longitudinally within a track or positioning slot defined by the housing 102.

Figure 1E:
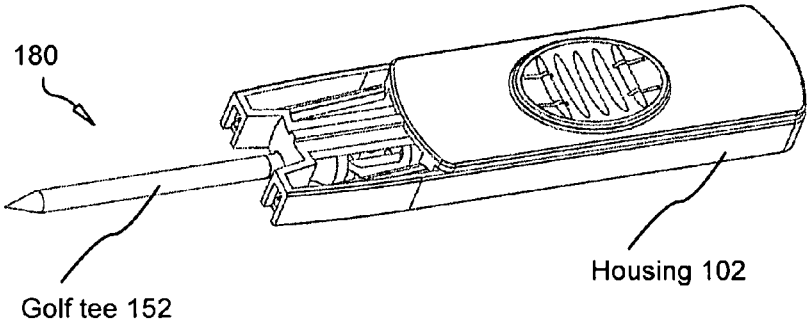
FIG. 1E is an environmental elevational frontal-side perspective view of a device for measuring the length of a golf tee and a golf tee in accordance with the present invention.

FIG. 1E is an environmental elevational frontal-side perspective view of a device 180 for measuring the length of a golf tee in accordance with the present invention. The housing 102 of the measuring device 180 defines a positioning slot 254 (or open channel or track) (further defined below) running partially across the longitudinal axis (i.e. lengthwise axis) of the housing 102.

The golf tee 152 which is inserted into the positioning slot 254 and protrudes through the open aperture 104, is viewable by a user through the positioning slot 254, where the golf tee 152 abuts the button 106. The pointed, or tapered, end of the golf tee 152 shaft protrudes from the housing 102, while the conical end of the golf tee 152 having the cups for holding the ball remains outside, or partially outside, the housing 102 within the positioning slot 254.

Figure 2A:
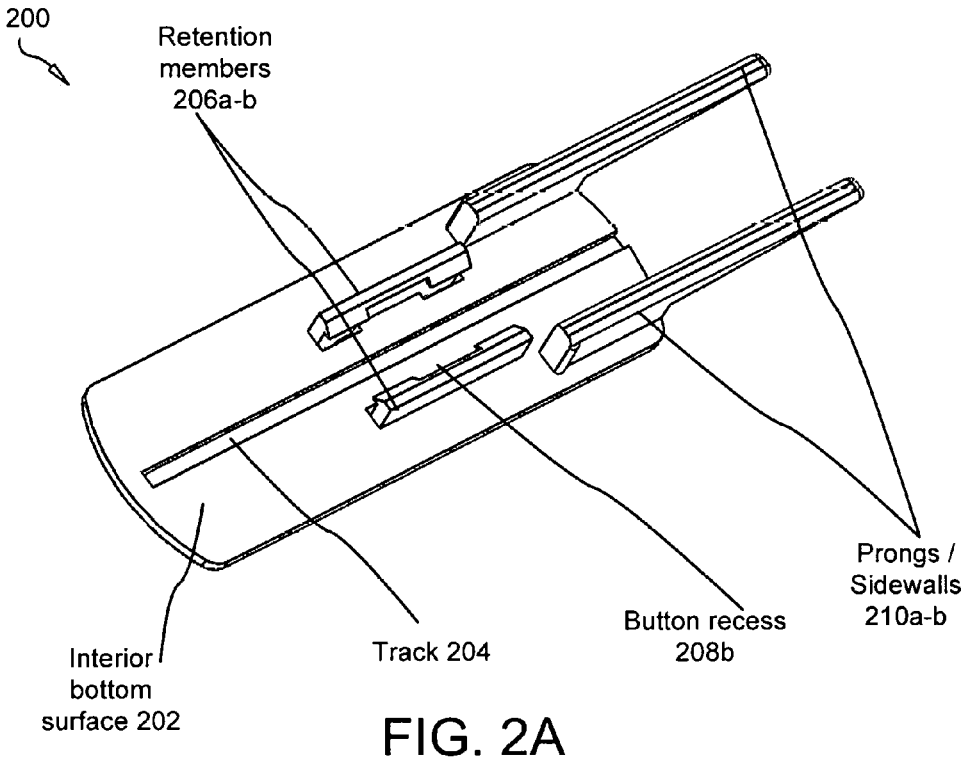
FIG. 2A is an elevational rear-side perspective view of a lower component of a device for measuring the length of a golf tee in accordance with the present invention.

FIG. 2A is an environmental elevational rear-side perspective view of lower component 200 of a device for measuring the length of a golf tee in accordance with the present invention.

The lower component 200 may be manufactured using methods known to those of skill in the art, including 3D printing. In the shown embodiments, the lower component 200 is fabricated from metal, elastomeric materials, or metal alloy for the purpose of adding strength to the prongs 210 used for replacing divots.

The lower component sliders longitudinally within the housing 102. When the lower component 200 is slid toward the front, or proximal end, of the housing 102, the prongs 210 protrude from the housing 102. In this manner the prongs 210 may be extruded for allowing a golfer to repair divots on the golf course. The prongs 210 are used for stabbing in fork-like fashion a divot which has been displaced by the ball landing on the putting surface.

The lower component 200 defines a guide track 204 within which a lower portion of the button 106 travels, which guide track 204 is recessed into the interior bottom surface 202 of the lower component 200. The guide track 204 helps provide lateral stability to the button 106 as it travels on the longitudinal axis.

Two retention members 206*a-b* rise upwardly within the interior recess of the housing 102 from the interior bottom surface 202 of the lower component. These retention members 206*a-b* protrude from, are affixed to, and in some embodiments formed as a single integrated piece with, the interior bottom surface 202.

Each of the retention members 206*a-b* defines a hollow button recess 208 for receiving the button 106 in some embodiments. In depressing the button 106, the user may drop the button 106 away from grooves along side the positioning slot which prevent longitudinal movement of the button 106 in some embodiments, thus freeing the button 106 to travel along the track 204.

Figure 2B:
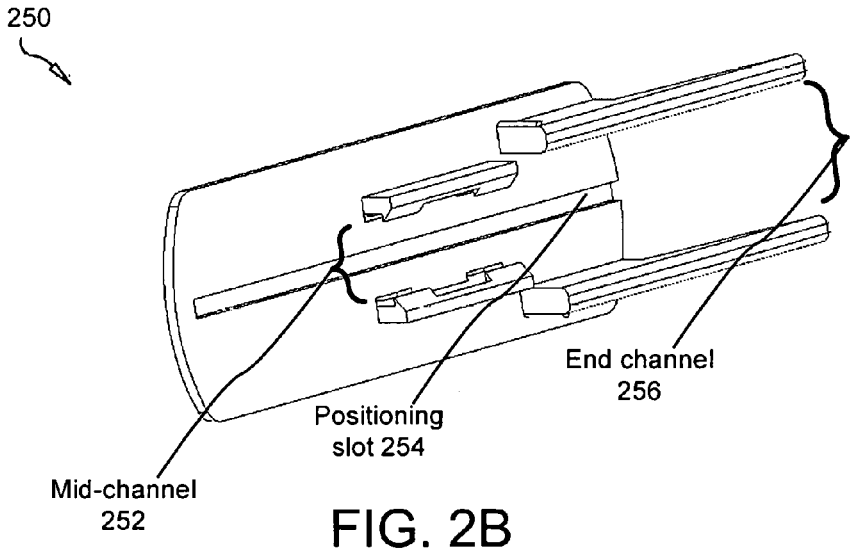
FIG. 2B is an elevational rear-side perspective view of a lower component of a device for measuring the length of a golf tee in accordance with the present invention.

FIG. 2B is an environmental elevational rear-side perspective view of a lower interior surface of the component 200 for measuring the length of a golf tee in accordance with the present invention.

The retention members 206*a-b* form, or define, a mid-channel 252 in which the button 106 may be partially housed or enveloped.

The sidewalls 210*a-b* define an end channel 256 which is wider than the mid-channel for fixing/repairing divots and receiving a shaft of a golf tee 152.

When the lower component 200 is slid forward, a hollow recess in the housing 102 may be exposed housing a quarter, coin, or other marker for marking the position of a golf ball on a ground surface.

When the prongs 210 are extruded, the device 100 is in an extruded configuration. When the prongs 210 are retracted, the device 100 is in a retracted configuration.

Figure 3:
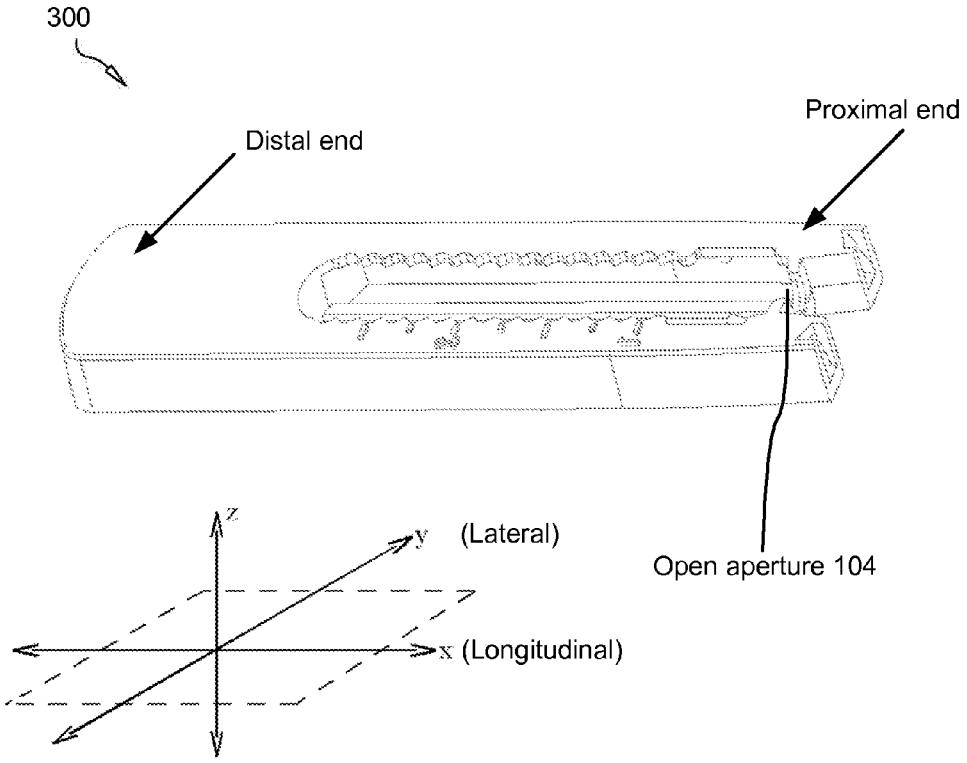
FIG. 3 is an elevational frontal-side perspective view of the housing of a device for measuring the length of a golf tee in accordance with the present invention.

FIG. 3 is an elevational frontal-side perspective view of the housing 102 of a device 300 for measuring the length of a golf tee and repairing divots in accordance with the present invention.

The distal end 302 and proximal end 304 of the housing 102 are shown, as are the x- (longitudinal), y- (lateral), and z-axes.

Figure 4:
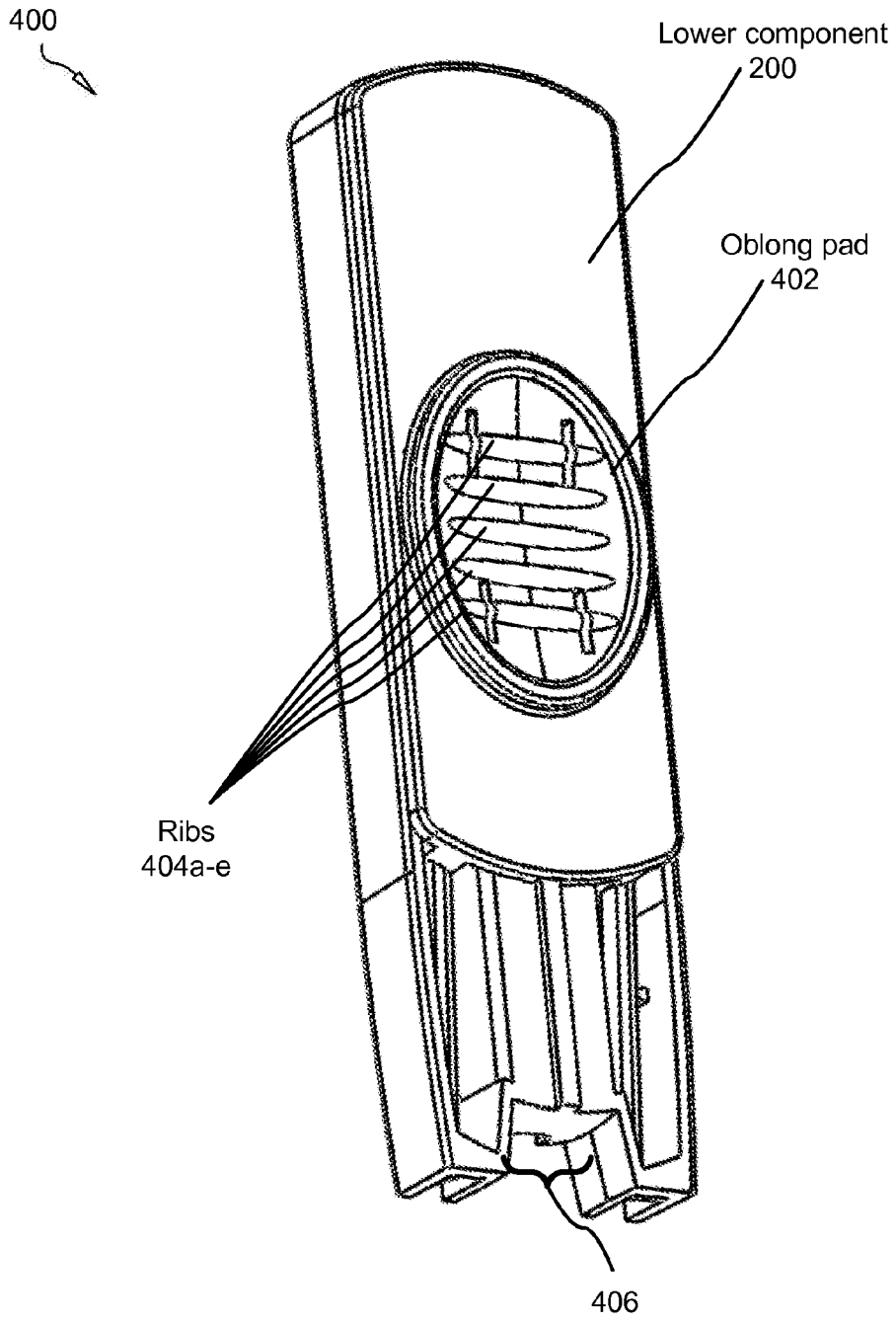
FIG. 4 is a lower-side perspective view of the housing of a device for measuring the length of a golf tee in accordance with the present invention.

FIG. 4 is a lower-side perspective view of the housing 400 of a device for measuring the length of a golf tee in accordance with the present invention.

In some embodiments, the lower component 200 comprises, or is affixed to, an oblong pad 402 for engaging the tip of a finger of the user. The oblong pad 402 juts downwardly from the exterior surface of the lower component 200.

In various embodiments, the oblong pad 402 comprises an elliptically-shaped edge which circumscribes the oblong pad 402. In other embodiments, the elliptical edge is recessed into the oblong pad 402 or the lower component 200.

The oblong pad 402 may comprise protruding ridges or ribs 404*a-e*, for engaging the finger of a user. The oblong pad 402 may also be described as an elliptical pad 402.

When the lower component 200 is pushed forward by a golfer using the oblong pad 402, the prongs 210 extrude from the housing for use in fixing divots.

The housing 102 defines a channel 406 or recess for receiving the shaft portion of the golf tee 152.

Figure 5A:
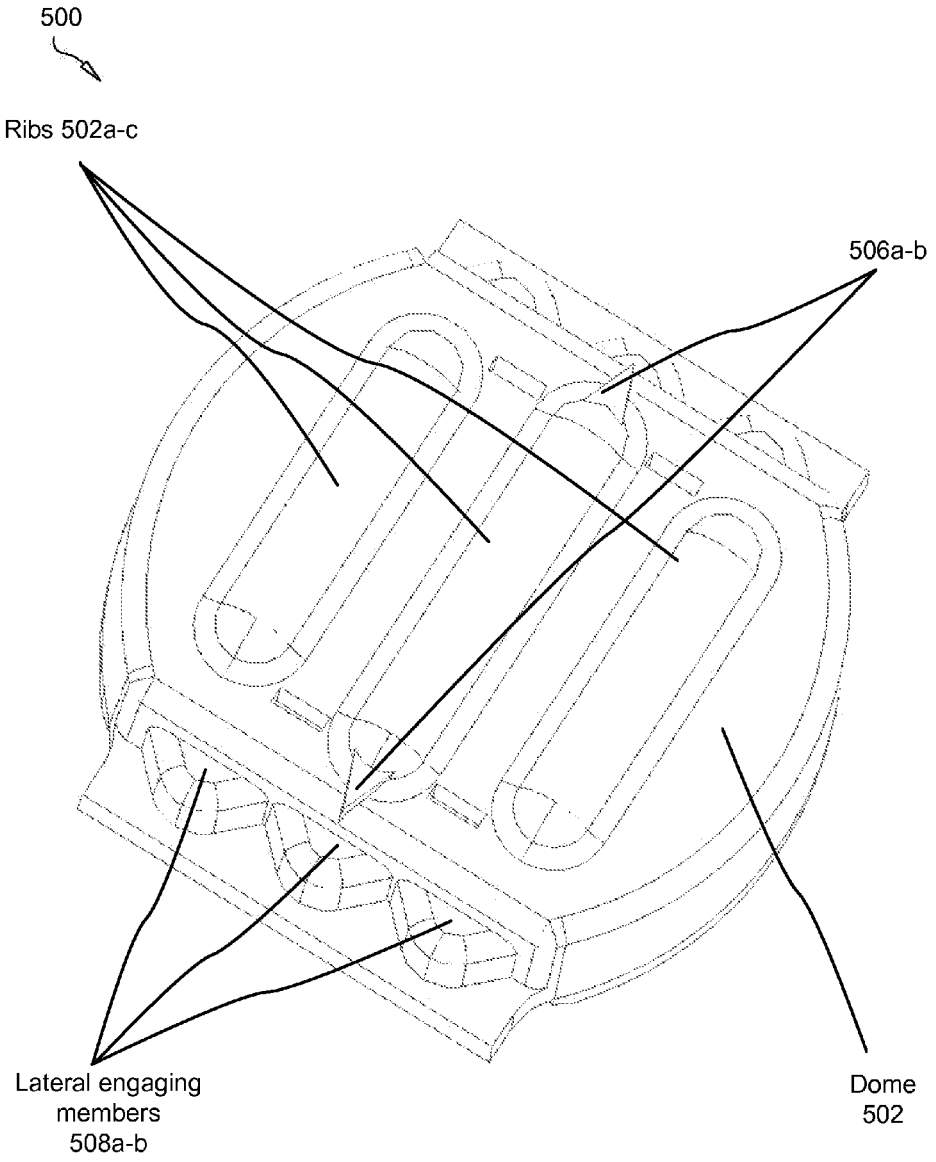
FIG. 5A is an elevational-side perspective view of the button of a device for measuring the length of a golf tee in accordance with the present invention.

FIG. 5A is an elevational-side perspective view of the button 500 of a device 160 for measuring the length of a golf tee in accordance with the present invention. The button 500 comprises ribs 502*a-c* and a dome 502.

The various embodiments the button 500 comprises the button 106. In various embodiments, the button 500 comprises a dome 502 or convex dome rising upwardly from the top of the housing 102 and resting in the positioning slot 254 for engaging the finger of a user.

The button 500 may comprise markings 506 for aligning the button with graduated linear markings on the housing 102. The button 500 may also comprise ridging or ribs 502*a-c* for engaging a finger of a user. The button 500 may also comprises lateral engaging members 508 for engaging and snapping into c-shaped recesses along side the positioning slot 254.

Figure 5B:
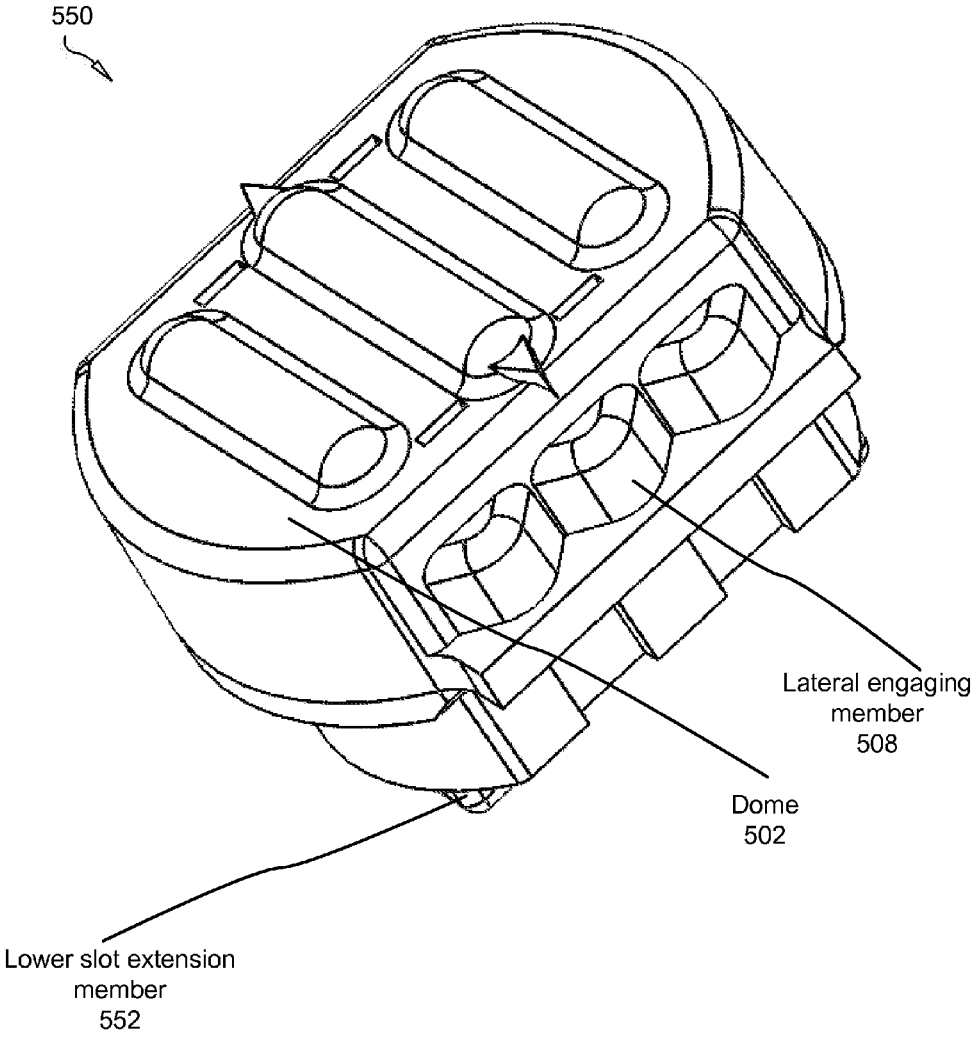
FIG. 5B is an elevational-side perspective view of the button of a device for measuring the length of a golf tee in accordance with the present invention.

FIG. 5B is an elevational-side perspective view of the button 550 of a device for measuring the length of a golf tee 152 in accordance with the present invention. The golf tee measuring device 550 comprises a lower slot extension member 552, a dome 502, and a lateral engaging member 508.

The lower slot extension member 552 juts downward from the bulk of the button assembly 550. The lower slot extension member 552 runs within the slot 204. The lateral engaging member 508 and dome 502 are substantially described above.

Figure 6:
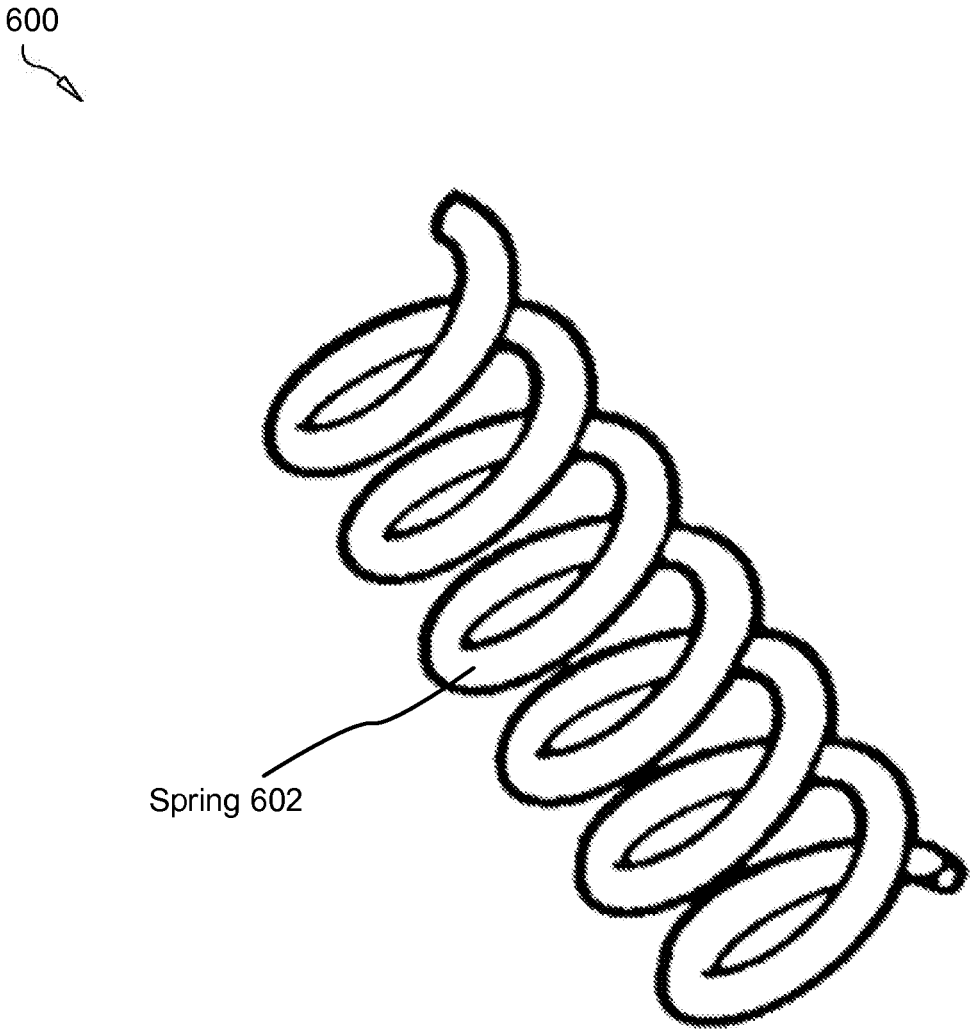
FIG. 6 is an elevational-side perspective view of the spring of a device for measuring the length of a golf tee in accordance with the present invention.

FIG. 6 is an elevational-side perspective view of the spring of a device 600 for measuring the length of a golf tee in accordance with the present invention.

The spring 602 is well known to those of skill in the art. In various embodiments, the spring 602 is disposed beneath, or rearwardly of, the button 106. In other embodiments, the spring 602 and/or a second spring is disposed beneath the button 106 and the lower bottom surface 202 biasing the button 106 upwards on the z-axis.

Figure 7A:
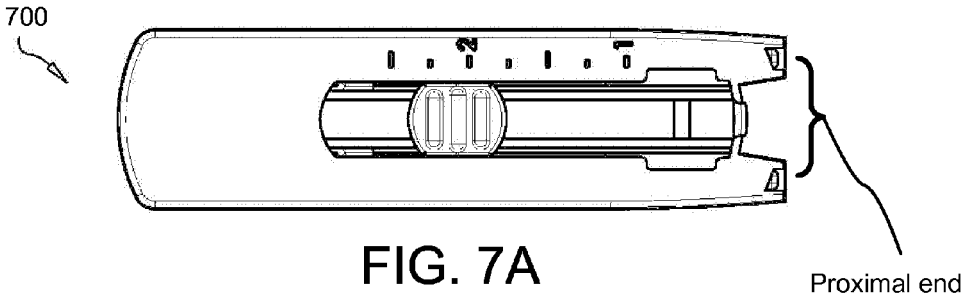
FIG. 7A is an elevational perspective view of a device for measuring the length of a golf tee in accordance with the present invention.

FIG. 7A is an elevational perspective view of a device 700 for measuring the length of a golf tee in accordance with the present invention.

As shown, in various embodiments, the positioning slot may be grooved or smooth.

Figure 7B:
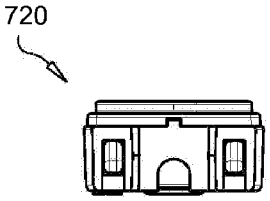
FIG. 7B is a forward (proximal) perspective view of a device for measuring the length of a golf tee in accordance with the present invention.

FIG. 7B is a forward (proximal) perspective view of a device 720 for measuring the length of a golf tee in accordance with the present invention.

As shown.

Figure 7C:
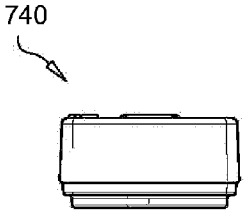
FIG. 7C is a distal (rearward) perspective view of a device for measuring the length of a golf tee in accordance with the present invention.

FIG. 7C is a distal (rearward) perspective view of a device 740 for measuring the length of a golf tee in accordance with the present invention.

As shown.

Figure 7D:
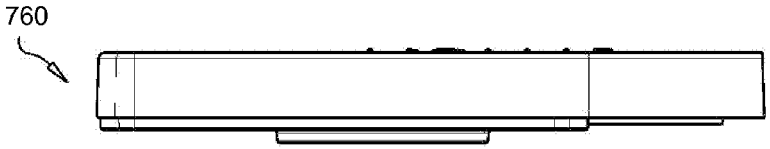
FIG. 7D is a side perspective view of a device for measuring the length of a golf tee in accordance with the present invention.

FIG. 7D is a side perspective view of a device 760 for measuring the length of a golf tee in accordance with the present invention.

As shown.

Figure 7E:
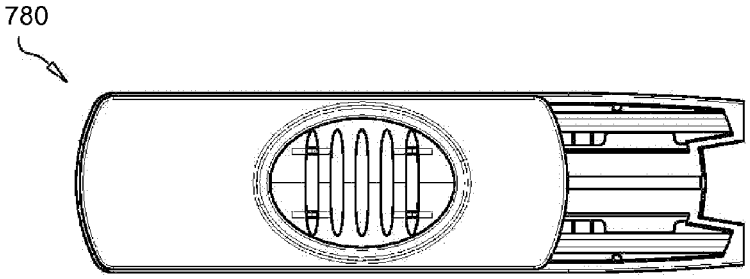
FIG. 7E is a lower perspective view of a device for measuring the length of a golf tee in accordance with the present invention.

FIG. 7E is a lower perspective view of a device 780 for measuring the length of a golf tee in accordance with the present invention.

As shown.

Figure 8A:
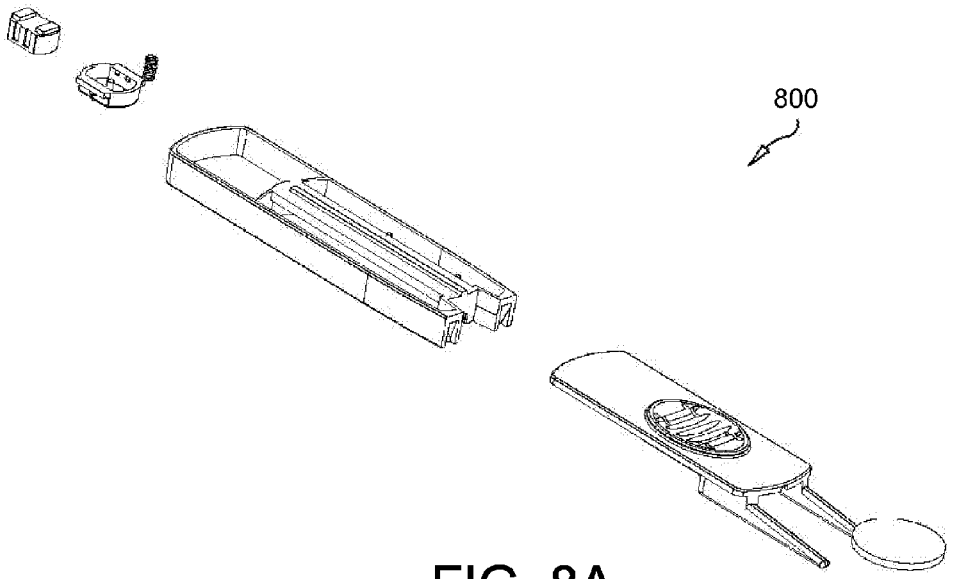
FIG. 8A is a lower perspective view of a disassembled device for measuring the length of a golf tee in accordance with the present invention.

FIG. 8A is a lower perspective view of a disassembled device for measuring the length of a golf tee in accordance with the present invention.

As shown.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A golf tee measuring device and divot repair tool, the device comprising:

a housing defining an open interior recess, the housing having a top surface, a distal end and a proximal end, the housing defining an open aperture on the proximal end for receiving a golf tee, the housing defining an open positioning slot running longitudinally part way across the top surface;

a lower component slidably affixed to the housing such that the lower component travels longitudinally across a predetermined distance with respect to the housing, the lower component comprising:

an interior surface having a guide track recessed into the interior surface, the guide track running in a longitudinal direction, the interior surface comprising a first set of retention members protruding upwardly within the open recess from the bottom surface; and, a pair of extrudable prongs for repairing a divot mounted on the lower component;

a plurality of measurement markings imprinted on the top surface of the housing in parallel with the positioning slot for measuring a length of a golf tee inserted into the housing;

a button which travels within the positioning slot and abuts the end of a golf tee inserted in the positioning slot.

2. The apparatus of claim 1, further comprising a spring housed within the open recess between the button and a distal end of the housing, the spring biasing the button toward the proximal end of the measuring device.

3. The apparatus of claim 1, further comprising an oblong pad integrated with the lower component and protruding downwardly therefrom, the oblong pad comprising a plurality of ribs for engaging a golfer's finger.

4. The apparatus of claim 1, wherein the button travels back and forth within the guide track in a longitudinal direction over a predetermined distance, locking in place when the button is released.

5. The apparatus of claim 1, wherein the button further comprises ribs for engaging a finger of the user.

6. The apparatus of claim 1, wherein the button further comprises markings for aligning the button with the linear markings on the housing.

7. The apparatus of claim 1, wherein the button further comprises markings for aligning the button with the linear markings on the housing.

8. The apparatus of claim 1, wherein the lower component slides longitudinally with respect to the housing to extrude the prongs from the housing, the prongs for stabbing and repairing a divot.

9. The apparatus of claim 1, wherein the hollow interior recess houses a marker for marking the position of a golf ball on a ground surface.

10. A golf tee measuring device and divot repair tool, the device comprising:

a housing defining an open interior recess, the housing having a top surface, a distal end and a proximal end, the housing defining an open aperture on the proximal end for receiving a golf tee and a marker, the housing defining an open positioning slot running longitudinally part way across the top surface;

a lower component slidably affixed to the housing such that the lower component travels longitudinally with respect to the housing, the lower component comprising:

an interior surface having a guide track recessed into the interior surface, the guide track running in a longitudinal direction; and, a pair of retractable prongs for repairing a divot, the prongs enveloped within the housing when the lower component is slid rearward, the prongs extruded when the lower component is slid forward;

a button which travels within the positioning slot and abuts the end of a golf tee inserted in the positioning slot.

11. The apparatus of claim 1, wherein the marker is insertable and removable when the apparatus is in an extruded configuration.

* * * * *